US006327755B1

(12) United States Patent
Wang

(10) Patent No.: US 6,327,755 B1
(45) Date of Patent: Dec. 11, 2001

(54) ZIPPER TEETH AND TOP STOP ARRANGEMENT FOR ZIPPER

(76) Inventor: Wallace Wang, 1F., No. 30, Lane 252, San Jiunn Street, Shu Lin Chen, Taipei Hsien (TW)

( * ) Notice: Subject to any disclaimer, the term of this patent is extended or adjusted under 35 U.S.C. 154(b) by 0 days.

(21) Appl. No.: 09/592,948

(22) Filed: Jun. 13, 2000

(51) Int. Cl.[7] ..... A44B 19/36
(52) U.S. Cl. ..... 24/436; 24/409
(58) Field of Search ..... 24/387, 388, 436, 24/435, 409

(56) References Cited

U.S. PATENT DOCUMENTS 2,894,305 * 7/1959 Brown .
4,023,241 * 5/1977 Kanzaka .
4,858,284 * 8/1989 Yoshimura .
5,653,002 * 8/1997 Ishihara et al. .
5,860,193 * 1/1999 Wang .
6,070,306 * 6/2000 Wang .

* cited by examiner

*Primary Examiner*—James R. Brittain
(74) *Attorney, Agent, or Firm*—Varndell & Varndell, PLLC

(57) ABSTRACT

A zipper teeth and top stop arrangement includes a zipper tape, a row of teeth injection-molded on the zipper tape, a slide sliding on the row of teeth, and a top stop injection-molded on the zipper tape and space from a first tooth of the row of teeth by a gap for stopping the sliding from escaping out of engagement with the zipper tape, wherein the first tooth of the row of teeth has an upper tooth body and a lower tooth body respectively disposed at top and bottom side of the zipper tape, the upper tooth body having a backward opening and a springy free arm suspended between the backward opening and the gap to stop the slide from escaping out of engagement with the zipper tape, the springy free arm being forced downwards by the slide for enabling the slide to be moved into engagement with the zipper tape during installation, the lower tooth body having a sloping top edge sloping backwardly downwards for guiding the slide into engagement with the zipper tape during installation of the slide in the zipper tape.

2 Claims, 10 Drawing Sheets

ZIPPER TEETH AND TOP STOP ARRANGEMENT FOR ZIPPER

BACKGROUND AND SUMMARY OF THE INVENTION

The present invention relates to zippers, and more specifically to a zipper teeth and top stop arrangement for zipper, which enables the slide to be quickly and positively installed, and prevents the slide from escaping out of the zipper tape after installation.

Various top stop and zipper teeth arrangements have been disclosed. Exemplars are seen in U.S. Pat. Nos. 5,860,193 and 6,070,306. The designs shown in U.S. Pat. Nos. 5,860, 193 and 6,070,306 are functional, however much effort should be employed during installation of the slide in the zipper tape.

It is the main object of the present invention to provide a zipper teeth and top stop arrangement for zipper, which enables the slide to be easily and positively inserted into position during its installation. It is another object of the present invention to provide a zipper teeth and top stop arrangement for zipper, which prevents the slide from escaping out of engagement with the zipper tape after its installation. According to the present invention, the first tooth of the row of teeth on the zipper tape comprises an upper tooth body and a lower tooth body respectively disposed at top and bottom sides of the zipper tape. The upper tooth body has a backward opening, and a springy free arm suspended between the backward opening and the top stop. The springy free arm is forced downward to broaden the gap between the top stop and the first tooth for enabling the slide to be easily inserted into position during installation of the slide. The springy free arm immediately returns to its former shape after installation of the slide, preventing the slide from backward movement. The lower tooth body has a sloping top edge sloping backwardly downwards for guiding the slide into engagement with the zipper taper during installation of the slide in the zipper tape.

DETAILED DESCRIPTION OF THE PREFERRED EMBODIMENT

Figure 1:
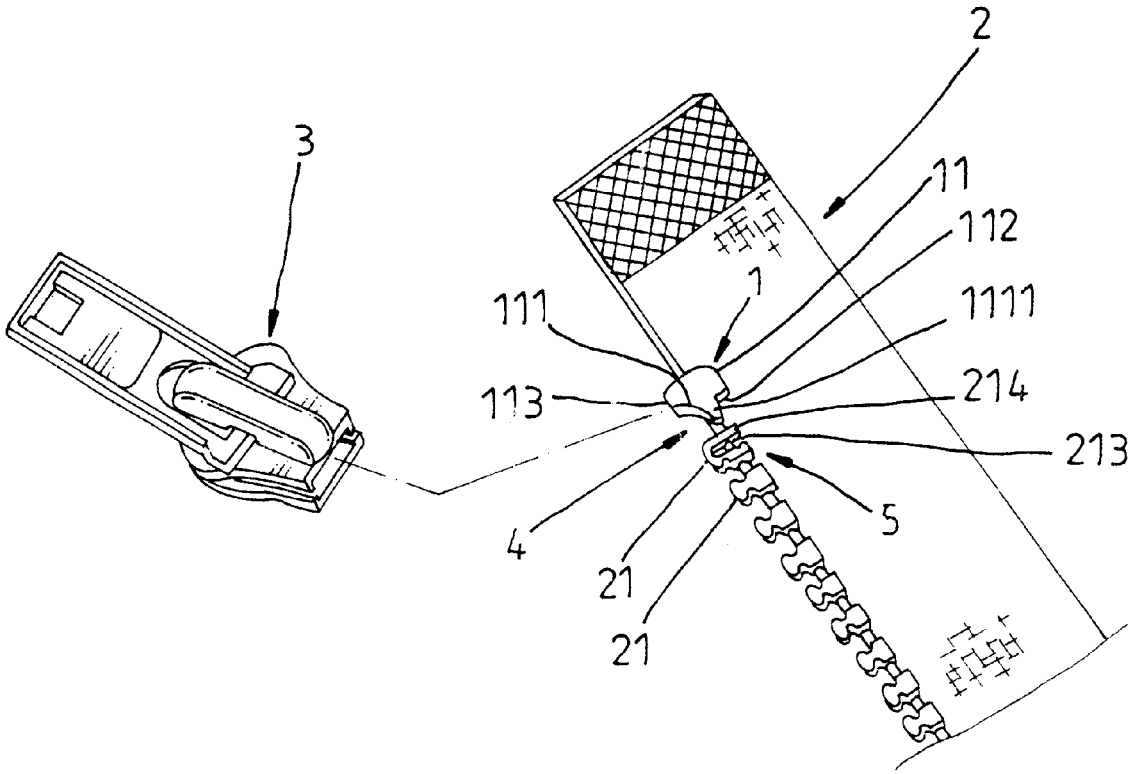
FIG. 1 illustrates the arrangement of a top stop and a row of teeth on a zipper tape before the installation of a slide according to the present invention.

Referring to FIG. 1 and FIGS. from 6 through 10, a top stop 1 is injection-molded on a zipper tape 2 at one end of the row of teeth 21 on a longitudinal side rib of the zipper tape 2. The top stop 1 comprises a stop block 11. The transverse length of the stop block 11 is greater than the length of the teeth 21. The stop block 11 comprises a sloping bottom edge 111 curved inwardly downwards and terminating in a downward bottom projection 1111, a front stop face 113 at the front side thereof remote from the zipper tape 2, and a rear stop projection 112 at the rear side thereof on the zipper tape 2. When the slide 3 is pulled to the upper limited position after installation, the rear stop projection 112 of the stop block 11 is stopped at a top edge 31 of the slide 3, and the front stop face 113 of the stop block 11 is stopped at one side 301 of an inside partition wall 30 of the slide 3, and therefore the slide 3 is stopped from escaping out of the constraint of the top stop 1. The sloping bottom edge 111 of the stop block 11 defines with the topmost edge of the first tooth 21 a gap 4 through which the slide 3 is inserted into engagement with the zipper tape 2.

Figure 2:
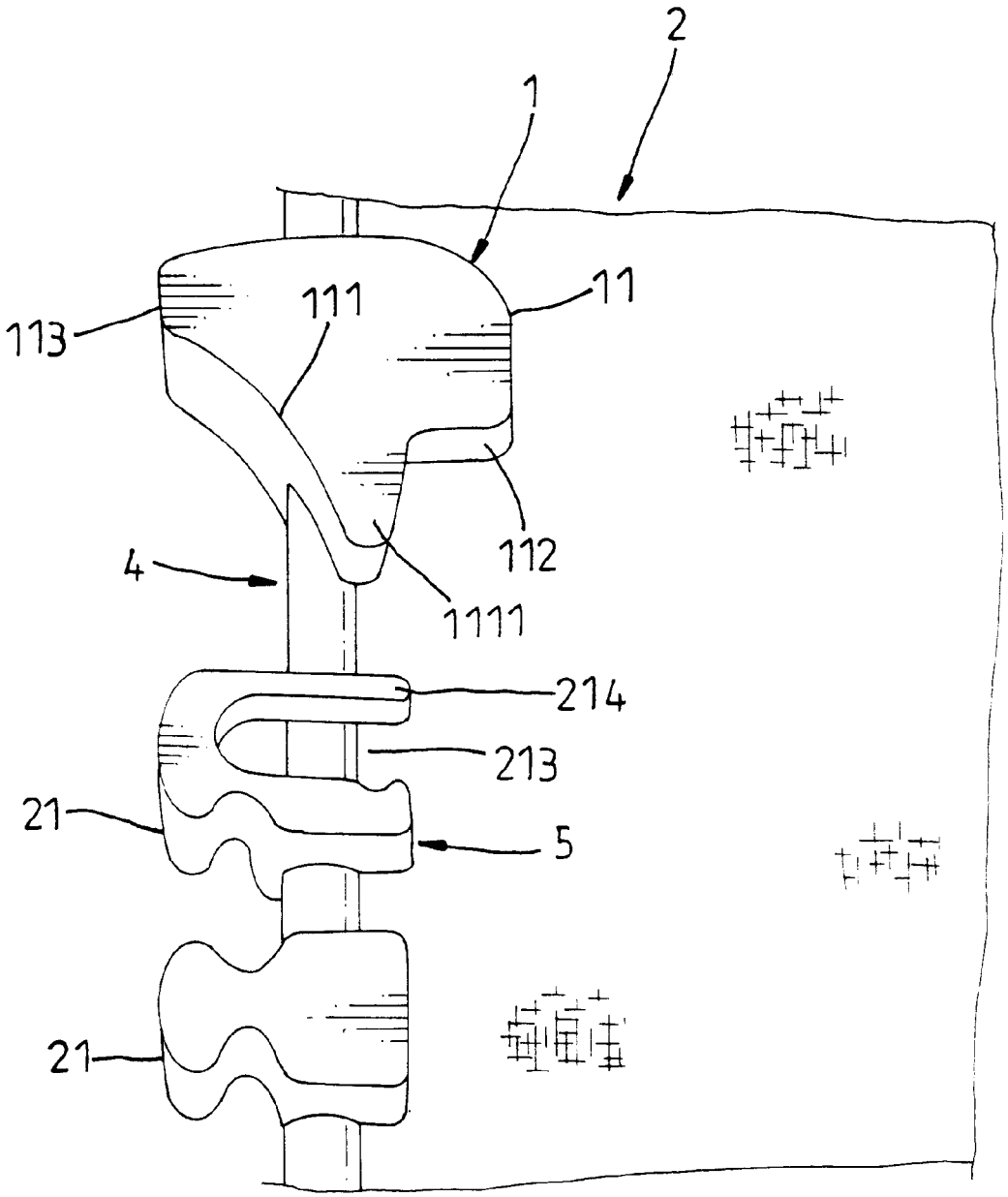
FIG. 2 is a top view in an enlarged view of a part of FIG. 1, showing the positioning of the top stop on the zipper tape relative to the first tooth.
Figure 3:
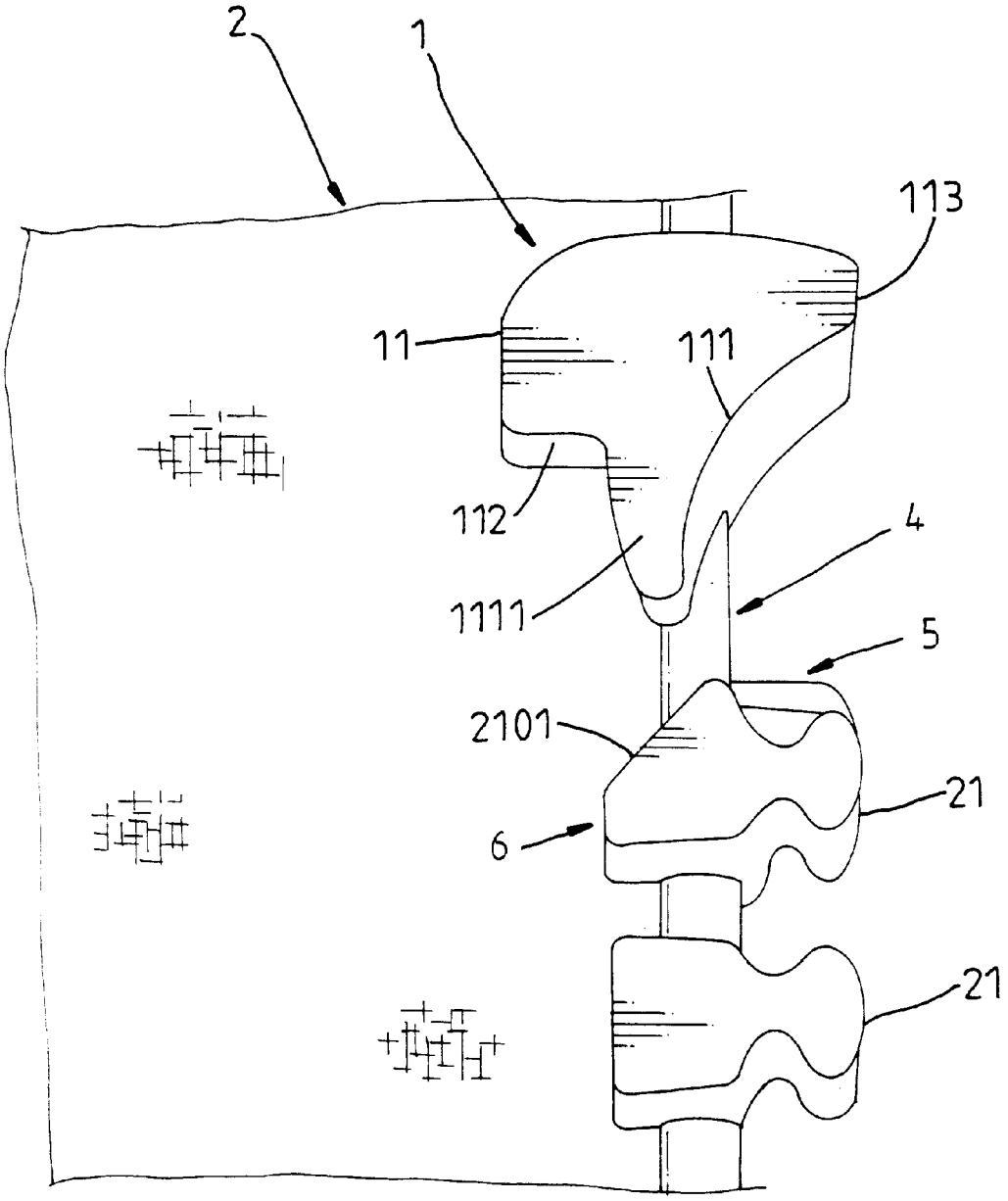
FIG. 3 is a bottom view of FIG. 2.
Figure 4:
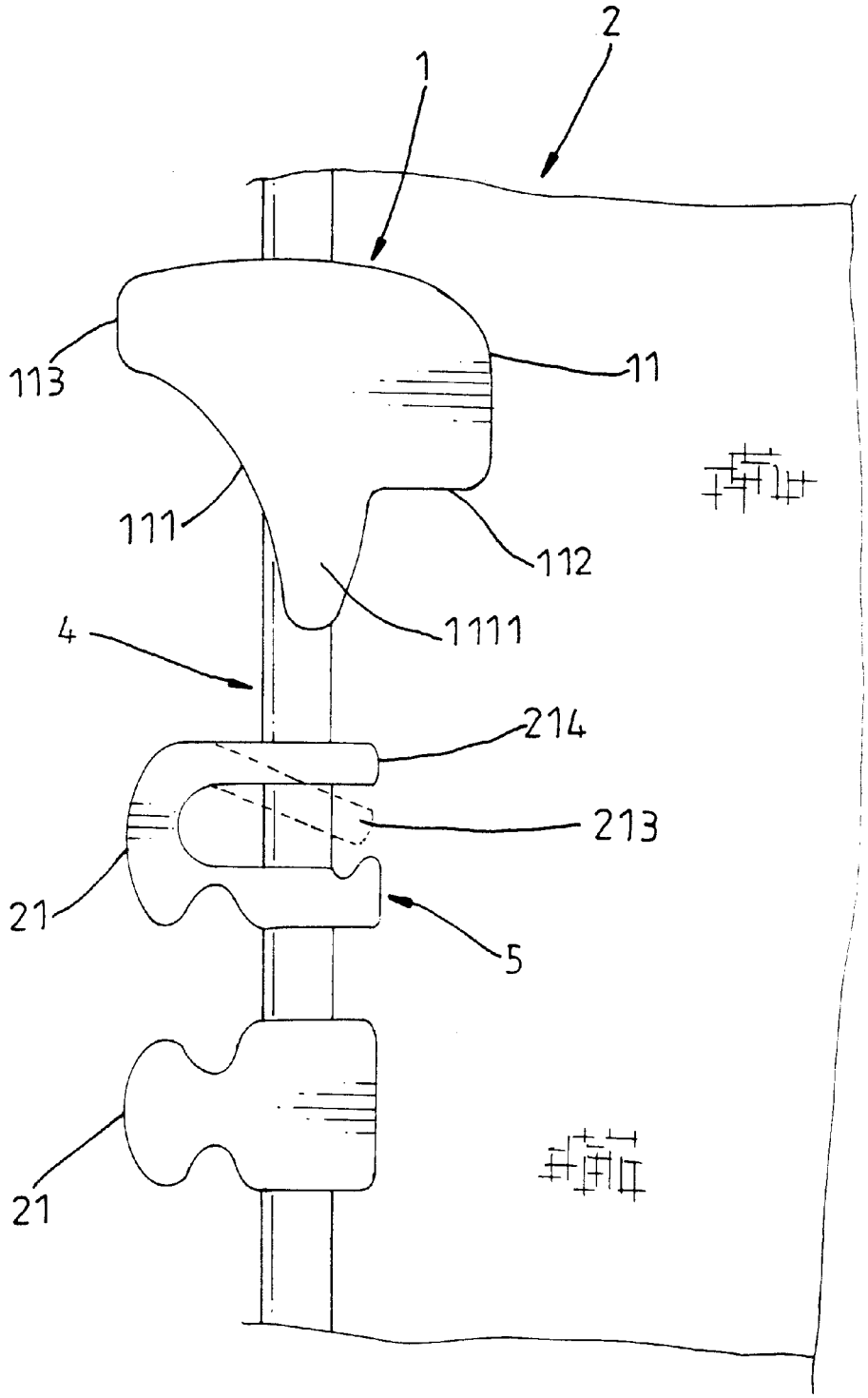
FIG. 4 is similar to FIG. 2 but showing the springy free arm forced downwards.
Figure 5:
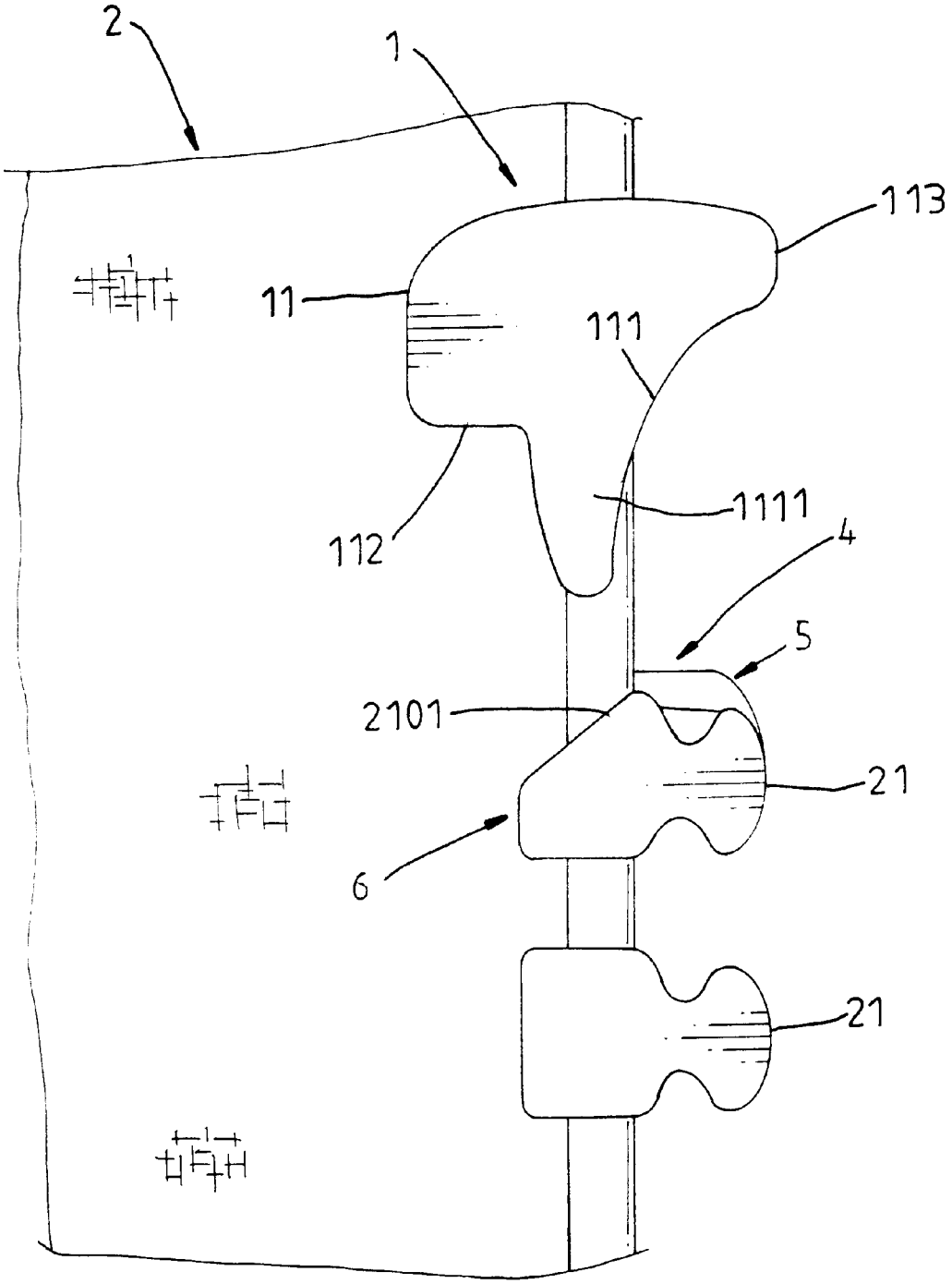
FIG. 5 is a bottom plain view in an enlarged scale of the present invention.
Figure 6:
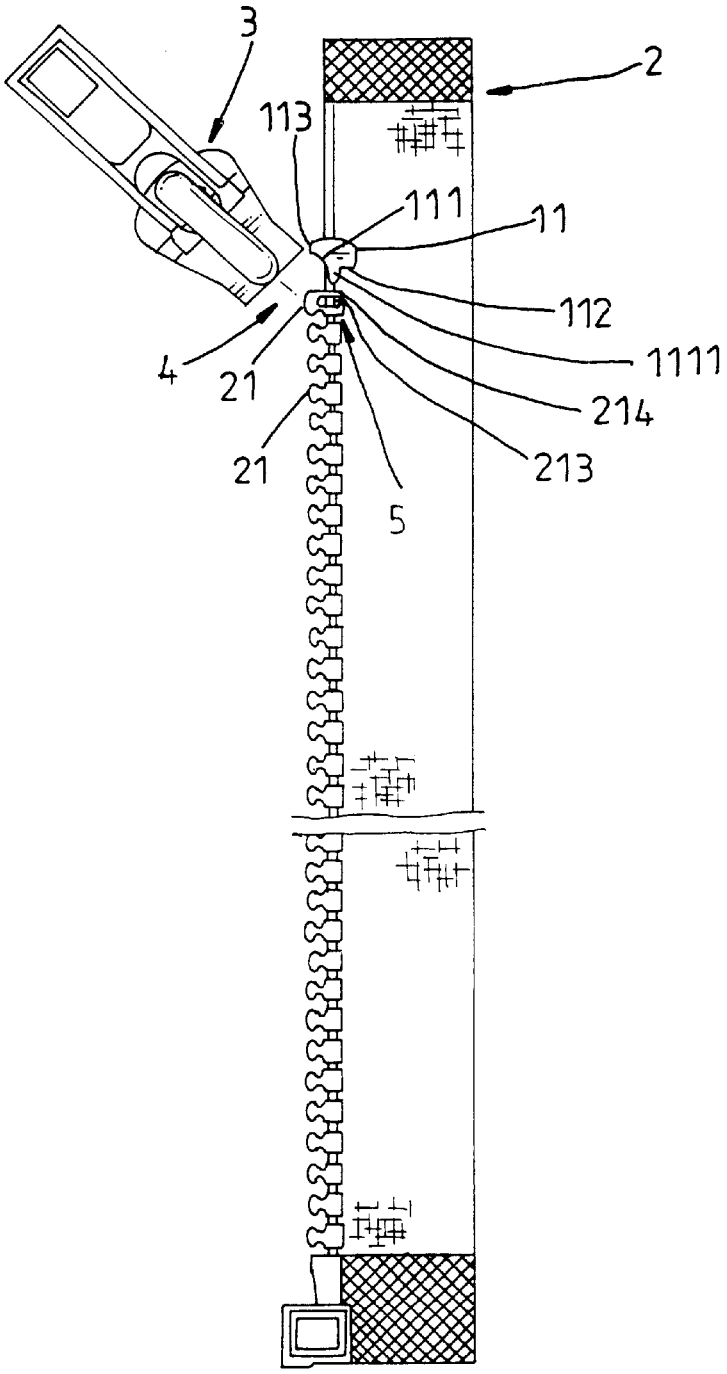
FIG. 6 is a top view of the present invention before insertion of the slide into the gap between the stop block and the first tooth.
Figure 7:
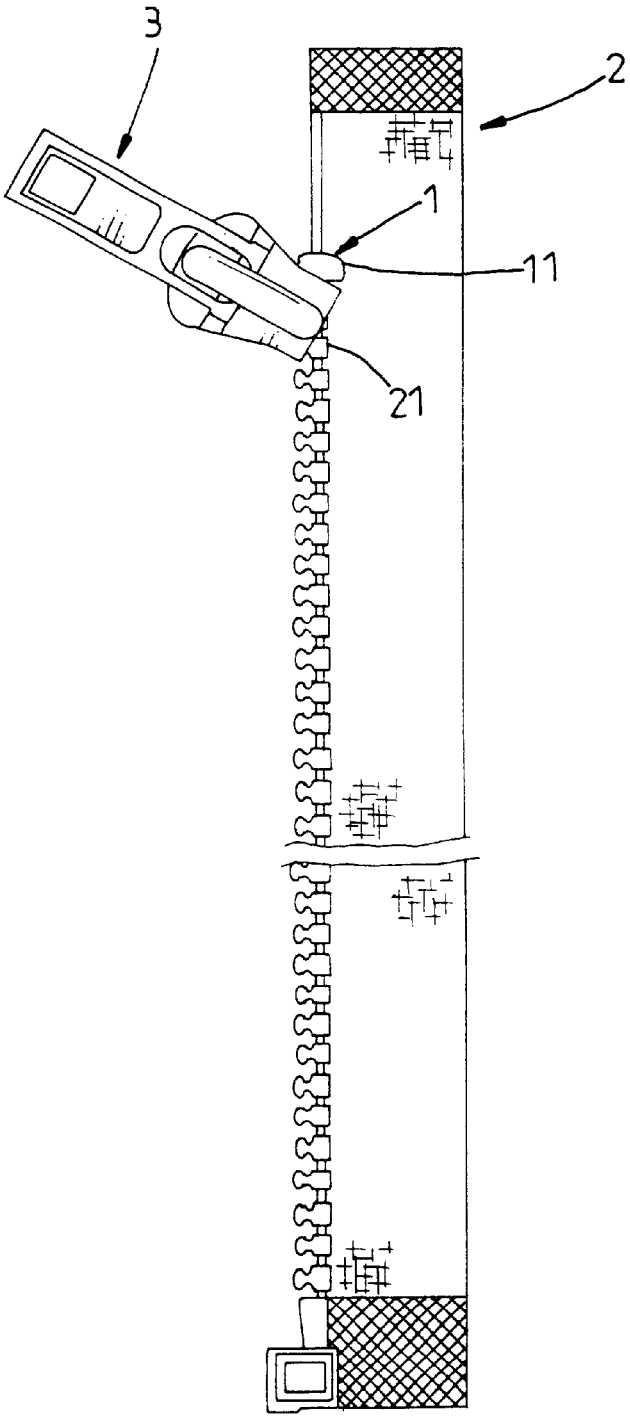
FIG. 7 is similar to FIG. 6 but showing the slide inserted into the gap between the stop block and the first tooth.
Figure 8:
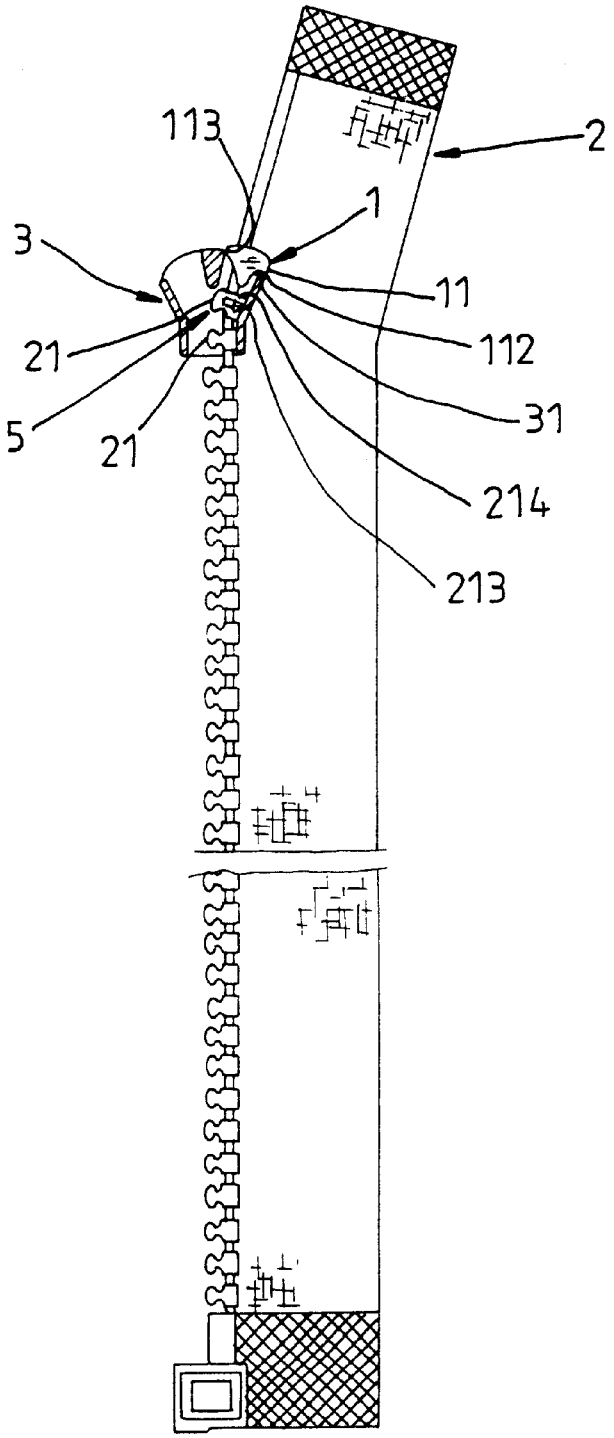
FIG. 8 illustrates the slide inserted into the gap between the stop block and the first tooth and engaged with the zipper tape according to the present invention.
Figure 9:
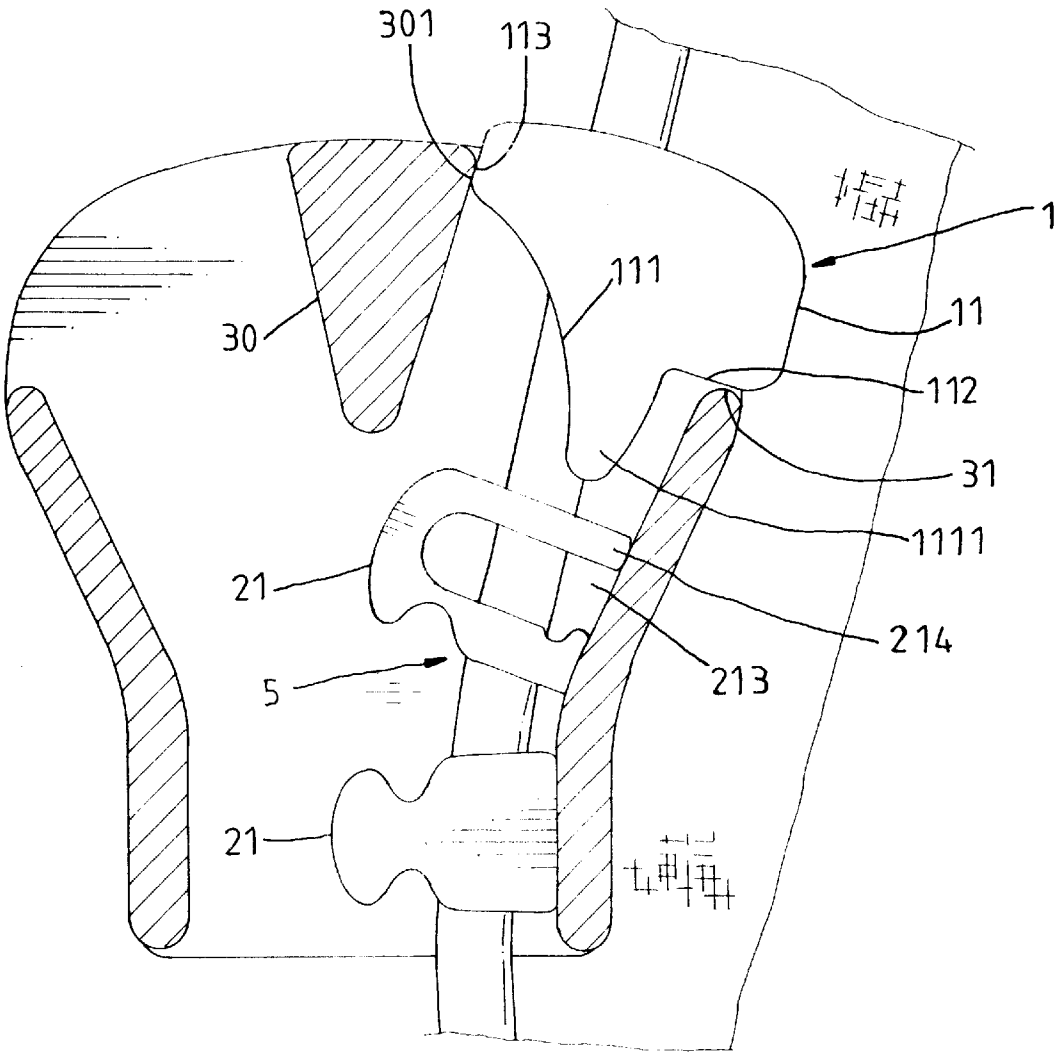
FIG. 9 is a sectional view in an enlarged scale of a part of the present invention, showing the slide engaged with the row of teeth on the zipper tape and stopped at the top stop.
Figure 10:
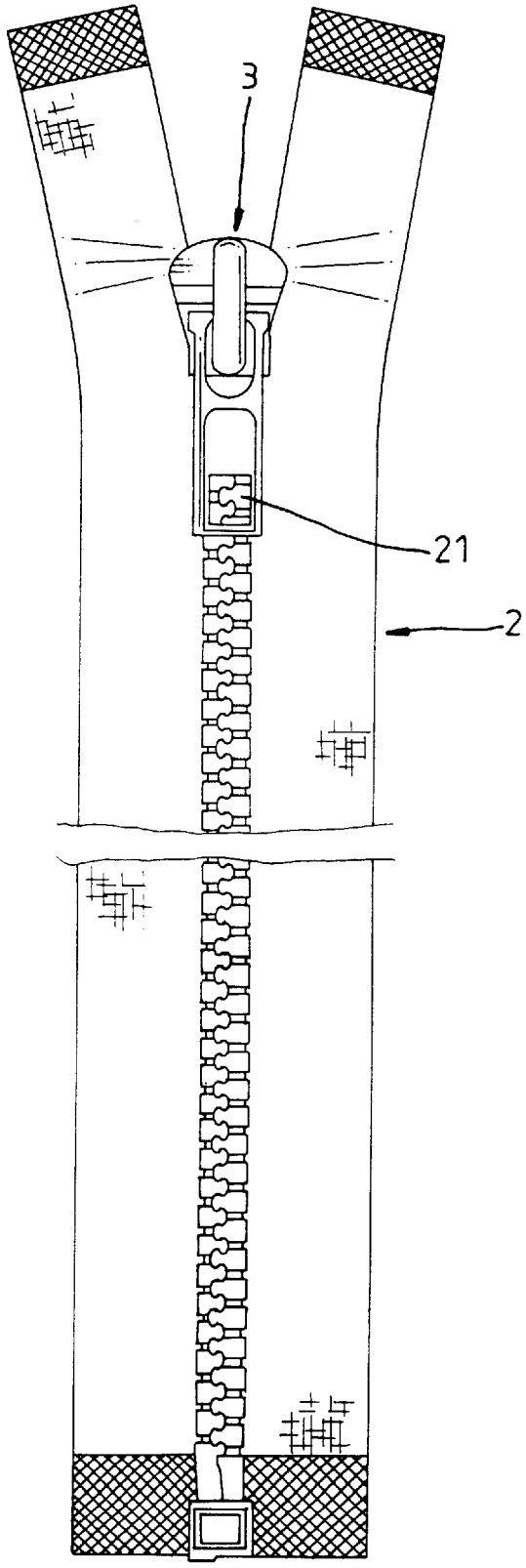
FIG. 10 is a plain view of the present invention, showing slide pulled to the upper limited position.

The first tooth 21 is injection-molded on the zipper tape 2, comprising an upper tooth body 5 and a lower tooth body 6 respectively disposed at top and bottom sides of the zipper tape 2. The upper tooth body 5 comprises a backward opening 213, and a springy free arm 214 backwardly extended thereof and suspended between the backward opening 213 and the gap 4 (see FIGS. 2 and 4). The lower tooth body 6 comprises a sloping top edge 2101 sloping backwardly downwards and defining with the sloping bottom edge 111 of the stop block 11 a part of the gap 4 (see FIGS. 3 and 5). When inserting the slide 2 through the gap 4 into engagement with the zipper tape 2, the springy free arm 214 is forced downwards toward the inside of the backward opening 213 (see the imaginary line shown in FIG. 4) to broaden the gap 4, enabling the slide 3 to be positively moved along the sloping top edge 2101 of the lower tooth body 6 into engagement with the zipper tape 2. After installation of the slide 3, the springy free arm 214 immediately returns to its former shape to stop the slide 3 from backward movement.

Further, the shape of the upper part of the stop block 11 is not exactly identical to the lower part of the stop block 11. The length of the upper part of the downward bottom projection 1111 at the top side of the zipper tape 2 is relatively shorter than the length of the lower part of the downward bottom projection 1111 at the bottom side of the zipper tape 2, that is, the vertical distance between the downward bottom projection 1111 of the stop block 11 and the springy free arm 214 of the upper tooth body 5 of the first tooth 21 is relatively greater than the vertical distance between the downward bottom projection 1111 of the stop block 11 and the topmost point of the sloping top edge 2101 of the lower tooth body 6 of the first tooth 21. This design enables the slide 3 to be easily and positively moved into engagement with the zipper tape 2.

What is claimed is:

1. A zipper tooth and top stop arrangement comprising a zipper tape having a longitudinal side rib, a plurality of teeth molded on said zipper tape in a row along said longitudinal side rib, a slide sliding on said row of teeth, and a top stop comprising a stop block disposed at said zipper tape and spaced from one end of said row of teeth to stop said slide from escaping out of said row of teeth, said stop block comprising a sloping bottom edge curved inwardly downwards and terminating in a downward bottom projection, a front stop face at a front side thereof remote from said zipper tape, and a rear stop projection at a rear side thereof on said zipper tape, said teeth including a first tooth defining with the sloping bottom edge of said stop block a gap through which said slide is inserted into engagement with said zipper tape, wherein said first tooth is injection-molded on said zipper tape, comprising an upper tooth body and a lower tooth body respectively disposed at top and bottom sides of said zipper tape, said upper tooth body comprising a backward opening, and a springy free arm backwardly extended thereof and suspended between said backward opening and said gap, said lower tooth body comprising a sloping top edge sloping backwardly downwards and defining with the sloping bottom edge of said stop block a part of said gap.

2. The zipper teeth and top stop arrangement of claim 1 wherein the downward bottom projection of said top stop has an upper part and a lower part respectively disposed at the top and bottom sides of said zipper tape, the upper part of the downward bottom projection of said stop stop being relatively shorter than the lower part of the downward bottom projection thereof.

* * * * *